US008259536B2

(12) United States Patent
Hasegawa et al.

(10) Patent No.: US 8,259,536 B2
(45) Date of Patent: Sep. 4, 2012

(54) ANALOG ELECTRONIC TIMEPIECE AND STEPPING MOTOR DRIVING METHOD

(75) Inventors: Kosuke Hasegawa, Fussa (JP); Teruhisa Tokiwa, Kunitachi (JP)

(73) Assignee: Casio Computer Co., Ltd, Tokyo (JP)

( * ) Notice: Subject to any disclaimer, the term of this patent is extended or adjusted under 35 U.S.C. 154(b) by 225 days.

(21) Appl. No.: 12/881,443

(22) Filed: Sep. 14, 2010

(65) Prior Publication Data

US 2011/0063953 A1 Mar. 17, 2011

(30) Foreign Application Priority Data

Sep. 15, 2009 (JP) ..... 2009-212837

(51) Int. Cl.
*G04B 19/04* (2006.01)

(52) U.S. Cl. ..... 368/80

(58) Field of Classification Search ..... 368/80, 368/72–76, 243–250, 223, 228
See application file for complete search history.

(56) References Cited

U.S. PATENT DOCUMENTS 4,537,514 A * 8/1985 Moriya ..... 368/107
4,623,261 A * 11/1986 Muto ..... 368/80
4,748,603 A * 5/1988 Ray et al. ..... 368/80
5,289,452 A * 2/1994 Sakamoto et al. ..... 368/73
5,379,281 A 1/1995 Koch
7,609,588 B2 * 10/2009 Tokoro et al. ..... 368/28

FOREIGN PATENT DOCUMENTS

| | | |
|---|---|---|
| EP | 1 253 489 | 10/2002 |
| GB | 2 087 601 | 5/1982 |
| GB | 2 154 767 | 9/1985 |
| JP | 57-066377 | 4/1982 |
| JP | 60-162980 | 8/1985 |

OTHER PUBLICATIONS

Extended European Search Report for European Application No. 10173994.4 mailed on Aug. 23, 2011.

* cited by examiner

*Primary Examiner* — Edwin A. Leon
(74) *Attorney, Agent, or Firm* — Turocy & Watson, LLP

(57) ABSTRACT

An analog electronic timepiece including, a plurality of hands, a plurality of stepping motors, a maximum speed of at least one stepping motor being different from that of another stepping motor, and a fast-forward control section to simultaneously drive at least two of the plurality of stepping motors, the fast-forward control section composed of, a speed judging section to judge the slowest speed among maximum speeds of stepping motors, a drive control section to simultaneously drive the stepping motors at the speed judged by the speed judging section, an end judging section to judge whether a further hand to be moved remains when drive of the stepping motors at the speed judged by the speed judging section ends, and a control section to make the speed judging section, the drive control section, and the end judging section operate again when the hand to be moved remains.

12 Claims, 7 Drawing Sheets

FIG. 3

| | MAXIMUM FAST-FORWARD SPEED | NUMBER OF MOVEMENT STEPS |
|---|---|---|
| FIRST STEPPING MOTOR | 64pps | 32 STEPS |
| SECOND STEPPING MOTOR | 64pps | 16 STEPS |
| THIRD STEPPING MOTOR | 32pps | 8 STEPS |
| FOURTH STEPPING MOTOR | 64pps | 24 STEPS |
| FIFTH STEPPING MOTOR | 32pps | 24 STEPS |

ANALOG ELECTRONIC TIMEPIECE AND STEPPING MOTOR DRIVING METHOD

BACKGROUND OF THE INVENTION

1. Field of the Invention

The present invention relates to an analog electronic timepiece and a stepping motor driving method.

2. Description of Related Art

There has been an analog electronic timepiece wherein a plurality of hands are driven with a plurality of stepping motors (also called stepping motors) heretofore. In such an analog electronic timepiece, the control of fast-forwarding the hands is performed by driving the stepping motors at a high speed, in the case where the content of the information indicated by the hands is changed by changing a function, the case where the hands are returned to reference positions or are forwarded to predetermined time positions, or the like.

The fastest drive speed of each of the stepping motors for driving the hands has a limit owing to the specifications of the motor itself, the specifications of the gear train mechanism for transmitting the motion of the motor to a hand, the specifications of a drive pulse for driving the motor, and the like. Then, the maximum drive speed at which the hand can be fast-forwarded stably and efficiently is set as the fast-forward speed within the limit. In an analog electronic timepiece having a plurality of stepping motors, the fast-forward speeds set to the respective stepping motors sometimes differ from each other, one fast-forward speed being 64 pps (pulses per second: the number of drive steps for a second), and another fast-forward speed 48 pps, for example.

In conventional analog electronic timepieces, some timepieces adopted the system of performing fast-forward drives of a plurality of stepping motors in order, when fast-forwarding a plurality of systems of hands by driving the plurality of stepping motors at high speeds, as follows: the hand of a first system was first subjected to the fast-forward drive of a first stepping motor; after the completion of the fast-forward drive of the first stepping motor, the hand of a second system was subjected to the fast-forward drive of a second stepping motor; and so forth. Furthermore, some timepieces adopted the system of fast-forwarding two systems of hands together by driving a plurality of stepping motors to which the same fast-forward speed was set at the same time.

Furthermore, as a technique related to the present invention, Japanese Patent Application Laid-Open Publication No. Sho 60-162980 discloses the technique of driving two motors at the same time at a fast-forward speed which is one step lower than that at the time of fast-forwarding only the hand of one system, lest an electric power shortage should take place, when the hands of two systems are simultaneously fast-forwarded by driving the two motors.

When the hands of a plurality of systems are fast-forwarded by performing the fast-forward drives of a plurality of stepping motors, the problem exists in which the total time of the fast-forward processing becomes long, if the fast-forwarding is performed to each of the hands of systems one by one in order.

Furthermore, it can also be considered to adopt the system of fast-forwarding the hands of a plurality of systems at the same time by driving a plurality of stepping motors in parallel at the same time at different fast-forward speeds, set to the respective stepping motors, in order to shorten the time of the fast-forward processing. However, the timing control according to the fast-forward speeds becomes necessary, in order to perform the fast-forward drives of the stepping motors. Consequently, in order to drive the plurality of stepping motors at different fast-forward speeds in parallel at the same time, it becomes necessary to perform a plurality of kinds of timing control according to the different fast-forward speeds, respectively, in parallel at the same time, and the problem in which the configuration of the timing control becomes complicated is caused.

SUMMARY OF THE INVENTION

It is, therefore, a main object of the present invention to provide an analog electronic timepiece and a stepping motor driving method, both capable of completing a fast-forward operation in a short time when fast-forwarding a plurality of hands with a plurality of stepping motors having maximum speeds different from each other.

According to a first aspect of the present invention, there is provided an analog electronic timepiece including, a plurality of hands to indicate time, a plurality of stepping motors to drive the plurality of hands respectively, a maximum speed of at least one stepping motor being different from a maximum speed of another stepping motor among the plurality of stepping motors, and a fast-forward control section to simultaneously drive at least two of the plurality of stepping motors to simultaneously fast-forward at least two of the plurality of hands, the fast-forward control section including, a speed judging section to judge the slowest speed among maximum speeds of stepping motors of hands to be moved among the plurality of stepping motors, a drive control section to simultaneously drive the stepping motors of the hands to be moved at the speed judged by the speed judging section, an end judging section to judge whether a further hand to be moved remains or not when drive of the stepping motors at the speed judged by the speed judging section ends, and a control section to make the speed judging section, the drive control section, and the end judging section operate again when the end judging section judges that the hand to be moved remains.

According to a second aspect of the present invention, there is provided a stepping motor driving method of an analog electronic timepiece having a plurality of hands to indicate time, and a plurality of stepping motors to drive the plurality of hands respectively, a maximum speed of at least one stepping motor being different from a maximum speed of another stepping motor among the plurality of stepping motors, to simultaneously drive at least two of the plurality of stepping motors to simultaneously fast-forward at least two of the plurality of hands, the method including the steps of, judging the slowest speed among maximum speeds of stepping motors of hands to be moved among the plurality of stepping motors, simultaneously driving the stepping motors of the hands to be moved at the speed judged at the step of judging the slowest speed, judging whether a further hand to be moved remains or not when drive of the stepping motors at the speed judged at the step of judging the slowest speed ends, and performing the steps of judging the slowest speed, simultaneously driving the stepping motors, and judging whether the further hand to be moved remains or not again when it is judged that the hand to be moved remains.

The present invention has the advantage of enabling the time necessary for the fast-forward control of a plurality of hands to be shortened.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 3 is a chart showing the maximum fast-forward speed of each stepping motor and the number of movement steps of each stepping motor in a first example of fast-forward control processing;

DESCRIPTION OF THE PREFERRED EMBODIMENTS

In the following, an embodiment of the present invention will be described with reference to the accompanying drawings.

Figure 1:
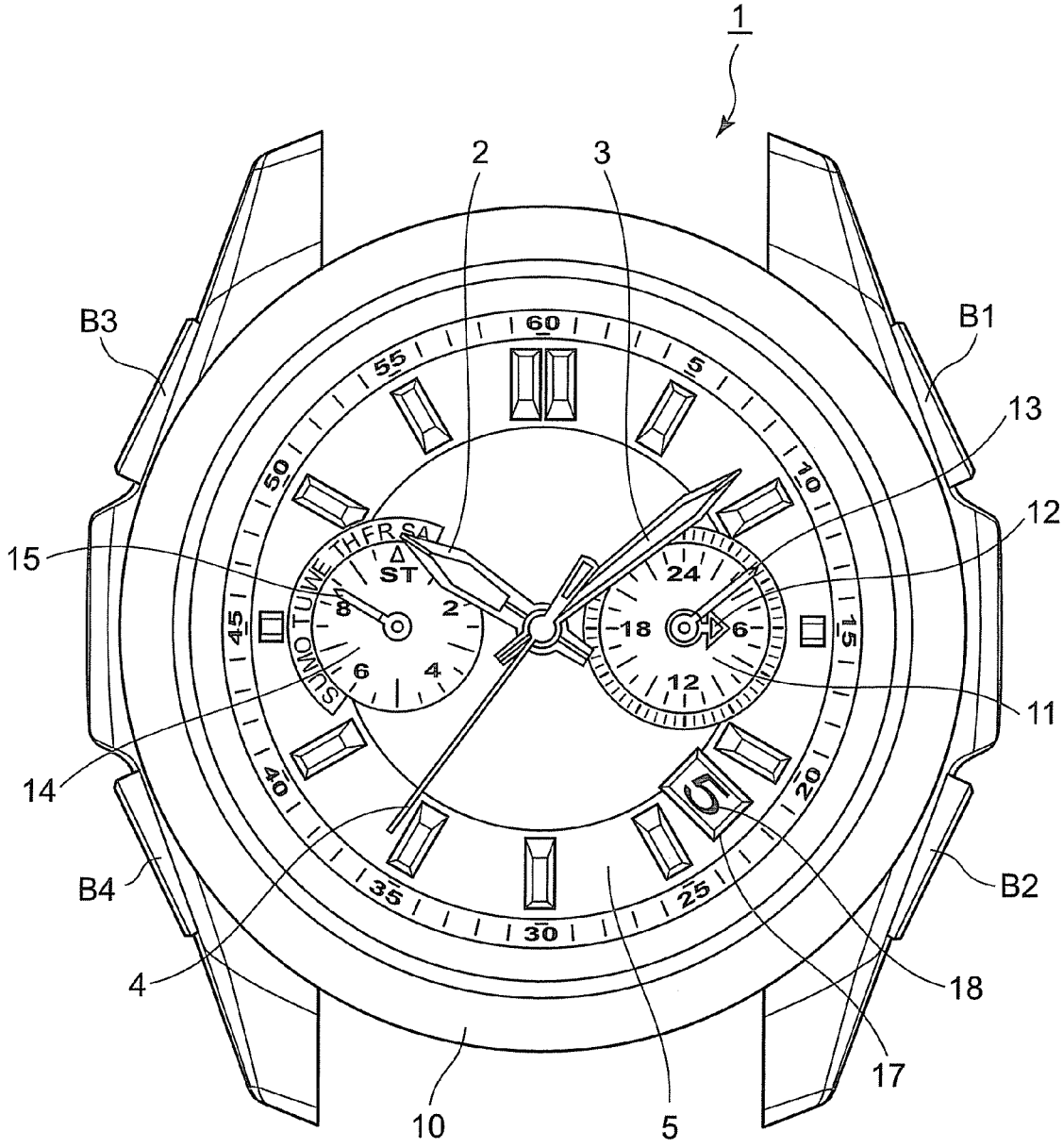
FIG. 1 is a front view showing the external appearance configuration of an analog electronic timepiece according to an embodiment of the present invention.

FIG. 1 is a front view showing the external appearance configuration of an analog electronic timepiece of the embodiment of the present invention.

As shown in FIG. 1, the analog electronic timepiece 1 of this embodiment is configured in such a way that a dial plate 5 is provided in the inner part enclosed by a casing 10 on the outer periphery and a windshield on the front face, and that an hour hand 2, a minute hand 3, a second hand 4, a 24-hour hour hand 12, a 24-hour minute hand 13, and a 1/10 second hand 15 are severally rotatably arranged over the dial plate 5. Furthermore, a date indicator 18 as a rotating disk is rotatably provided on the back of the dial plate 5, and a part in which dates are written is exposed from an aperture portion 17 in the dial plate 5 to the outside. Furthermore, four manual operation buttons B1-B4 are provided on a side surface of the casing 10.

The hour hand 2, the minute hand 3, and the second hand 4 are configured to rotate almost all over the whole region of the dial plate 5. On the other hand, the 24-hour hour hand 12 and the 24-hour minute hand 13 are configured to rotate in a small window 11 provided at a three o' clock position of the dial plate 5, and the 1/10 second hand 15 is configured to rotate in a small window 14 provided at a nine o' clock position of the dial plate 5.

The hour hand 2, the minute hand 3, and the second hand 4 indicate the present time at normal times, but sometimes indicate, for example, the set time of an alarm or indicate various operation states with the second hand 4, by changing the operation mode of the timepiece 1. Alternatively, the hands 2, 3, and 4 are sometimes returned to the reference position (the position of 0:0:0) for correcting the positions of the hands 2, 3, and 4. Furthermore, what the 24-hour hour hand 12 and the 24-hour minute hand 13 indicate is sometimes changed from the present time of Japan to that of a designated foreign city, by changing the operation mode of the timepiece 1. Furthermore, although the 1/10 second hand 15 also indicates the present day of the week at normal times, the 1/10 second hand 15 is configured to move to the reference position once and to stop there until a start instruction is input if the operation mode of the timepiece 1 is changed to the stopwatch mode.

The date indicator 18 is configured in order that the date exposed in the aperture portion 17 is changed by a day by being driven to rotate by a predetermined number of steps. Accordingly, the control of updating the date, displayed by the date indicator 18, is performed in such a way that, for example, the date indicator 18 is stopped at times other than those close to date changing time, and that the date indicator 18 is subjected to the fast-forward drive by the number of steps for changing the date for one day (several days at a change of a month) when the time becomes close to the date changing time.

Figure 2:
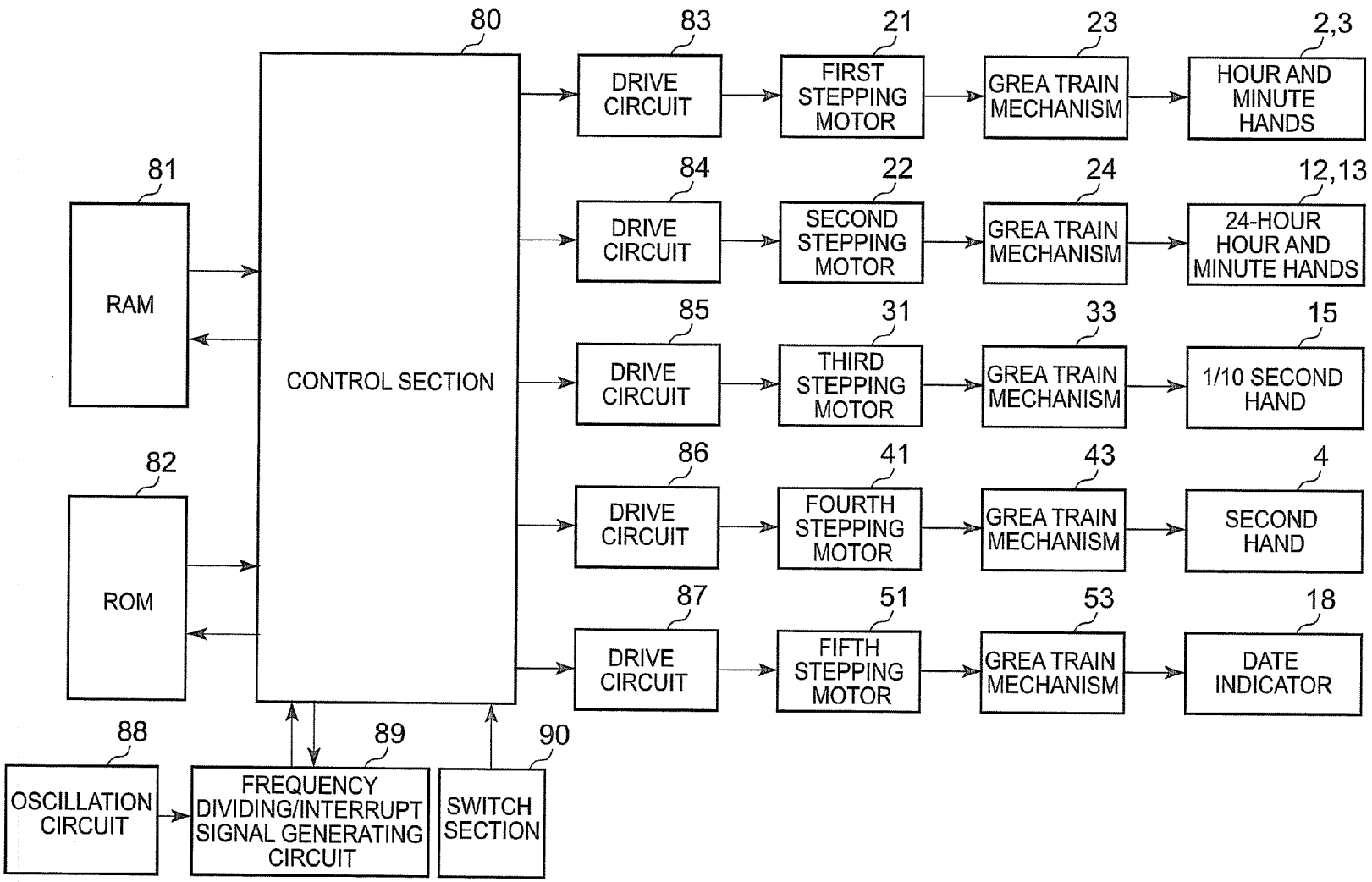
FIG. 2 is a block diagram showing the whole configuration of the analog electronic timepiece.

FIG. 2 shows a block diagram showing the whole configuration of the analog electronic timepiece 1.

The analog electronic timepiece 1 includes the plurality of hands 2-4, 12, 13, and 15 mentioned above, the date indicator 18 mentioned above, a first stepping motor 21 for rotating the hour hand 2 and the minute hand 3 with both of the hands 2 and 3 in conjunction with each other through a gear train mechanism 23, a second stepping motor 22 for rotating the 24-hour hour hand 12 and the 24-hour minute hand 13 with both of the hands 12 and 13 in conjunction with each other through a gear train mechanism 24, third to fifth stepping motors 31, 41, and 51 for rotating the 1/10 second hand 15, the second hand 4, and the date indicator 18, independent of one another, through gear train mechanisms 33, 43, and 53, respectively, a control section 80 as a fast-forward control section incorporating a central processing unit (CPU) therein to perform the whole control of the timepiece 1, drive circuits 83-87 for outputting drive pulses to the first to fifth stepping motors 21, 22, 31, 41, and 51, respectively, on the basis of the signals from the control section 80 to perform the step drives of the first to fifth stepping motors 21, 22, 31, 41, and 51, an oscillation circuit 88 for generating an oscillation signal having a constant period, a frequency dividing/interrupt signal generating circuit 89 as a signal generating section for dividing the frequency of the oscillation signal to generate a frequency signal operating as a standard for the hand movement timing of a hand at the time of an ordinary time display or at the time of fast-forward control, a switch section 90 for outputting an operation signal to the control section 80 when the manual operation buttons B1-B4 mentioned above are pushed, a random access memory (RAM) 81 for providing a working memory space to the CPU of the control section 80, and a read only memory (ROM) 82 for storing control programs to be executed by the CPU of the control section 80 and control data.

The frequency dividing/interrupt signal generating circuit 89 performs the frequency dividing of an oscillation signal of the oscillation circuit 88 to generate a predetermined frequency signal and supply the generated frequency signal to the control section 80. Furthermore, the frequency dividing/interrupt signal generating circuit 89 is adapted to be able to change the frequency dividing ratio of a signal according to a command from the control section 80, and thereby the frequency dividing/interrupt signal generating circuit 89 is adapted to be able to change the frequency of the frequency signal supplied to the control section 80 variously. For example, the frequency dividing/interrupt signal generating circuit 89 is adapted to generate and supply a frequency signal of 1 Hz to the control section 80 in the ordinary time display mode. Thereby, the counter of the control section 80 counts the frequency signal to perform timing. The control section 80 is configured to perform the drive control of the first to fifth stepping motors 21, 22, 31, 41, and 51 on the basis of the frequency signal and the timing data of the counter, and thereby the respective hands 2-4, 12, 13, and 15 and the date indicator 18 indicate a date and a time, and a day of the week.

Furthermore, this frequency dividing/interrupt signal generating circuit 89 generates frequency signals according to the maximum fast-forward speeds of the first to fifth stepping motors 21, 22, 31, 41, and 51, such as 64 Hz or 32 Hz, and supplies the generated frequency signals to the control section 80 at the time of fast-forward control, described below. Thereby, the control section 80 is adapted to perform the fast-forward drives of a part of or all of the first to fifth stepping motors 21, 22, 31, 41, and 51 on the basis of the frequency signals. Although the frequency signals of this frequency dividing/interrupt signal generating circuit 89 are not especially limited, the analog electronic timepiece 1 is configured to supply the frequency signals to the control section 80 as interrupt signals.

The ROM 82 stores a time display processing program for indicating a present date and time and a day of the week with the respective hands 2-4, 12, 13, and 15 and the date indicator 18, an operation input processing program for receiving an operation signal from the switch section 90 to change the operation mode of the timepiece 1, a fast-forward control processing program for fast-forwarding one of or a plurality of the plurality of hands 2-4, 12, 13, and 15 and date indicator 18 to a designated step position(s) on the basis of a change of the operation mode of the timepiece 1 etc., and the like, as the control programs to be executed by the CPU of the control section 80. Furthermore, the ROM 82 stores a data table of maximum fast-forward speeds set to the respective first to fifth stepping motors 21, 22, 31, 41, and 51 as control data.

FIG. 3 shows a chart showing the maximum fast-forward speeds of the respective stepping motors 21, 22, 31, 41, and 51 and the numbers of movement steps of the respective stepping motors 21, 22, 31, 41, and 51 in a first example of fast-forward control processing.

As shown in the column of "maximum fast-forward speed" of FIG. 3, the maximum fast-forward speeds at which the hands 2-4, 12, 13, and 15 or the date indicator 18 can stably be fast-forwarded are set to the first to fifth stepping motors 21, 22, 31, 41, and 51, and these maximum fast-forward speeds are stored in the data table of the maximum fast-forward speeds of the ROM 82. Namely, the maximum fast-forward speeds of the first, the second, and the fourth stepping motors 21, 22, and 41 are set to 64 pps (pulse per second: the number of drive steps for one second), and the maximum fast-forward speeds of the third and the fifth stepping motors 31 and 51 are set to 32 pps. Each of the stepping motors 21, 22, 31, 41, and 51 is configured in order to be capable of being subjected to a fast-forward drive at the maximum fast-forward speed set to each of them or at a lower speed than the set maximum fast-forward speed.

Next, the fast-forward control processing for fast-forwarding one or a plurality of the hands 2-4, 12, 13, and 15 and date indicator 18 to a designated step position (s) will be described.

In the fast-forward control processing of this embodiment, when all or some of the first to fifth stepping motors 21, 22, 31, 41, and 51 are set as the objects of the fast-forward control, the fast-forward drives of the plurality of stepping motors which are the objects of the fast-forward control are performed in parallel at the same time. Furthermore, the analog electronic timepiece 1 is configured in such a way that, if the respective maximum fast-forward speeds of the plurality of stepping motors which are the objects of the fast-forward control are not unified to one speed, the analog electronic timepiece 1 performs the fast-forward drives of the plurality of stepping motors in accordance with the slowest maximum fast-forward speed (the minimum fast-forward speed) among the maximum fast-forward speeds.

Furthermore, if the slowest maximum fast-forward speed is changed owing to a decrease of the number of the stepping motors which are the objects of the fast-forward control in the middle of a series of fast-forward control because a fast-forwarded hand or the like arrives at its aimed position, or owing to an increase of the number of the stepping motors which are the objects of the fast-forward control in the middle of the series of fast-forward control because a hand to be fast-forwarded is added, then the fast-forward control processing of the present embodiment is configured to change the drive speed (s) of one or a plurality of stepping motors to be subjected to the fast-forward drive (s), according to the change.

Figure 4:
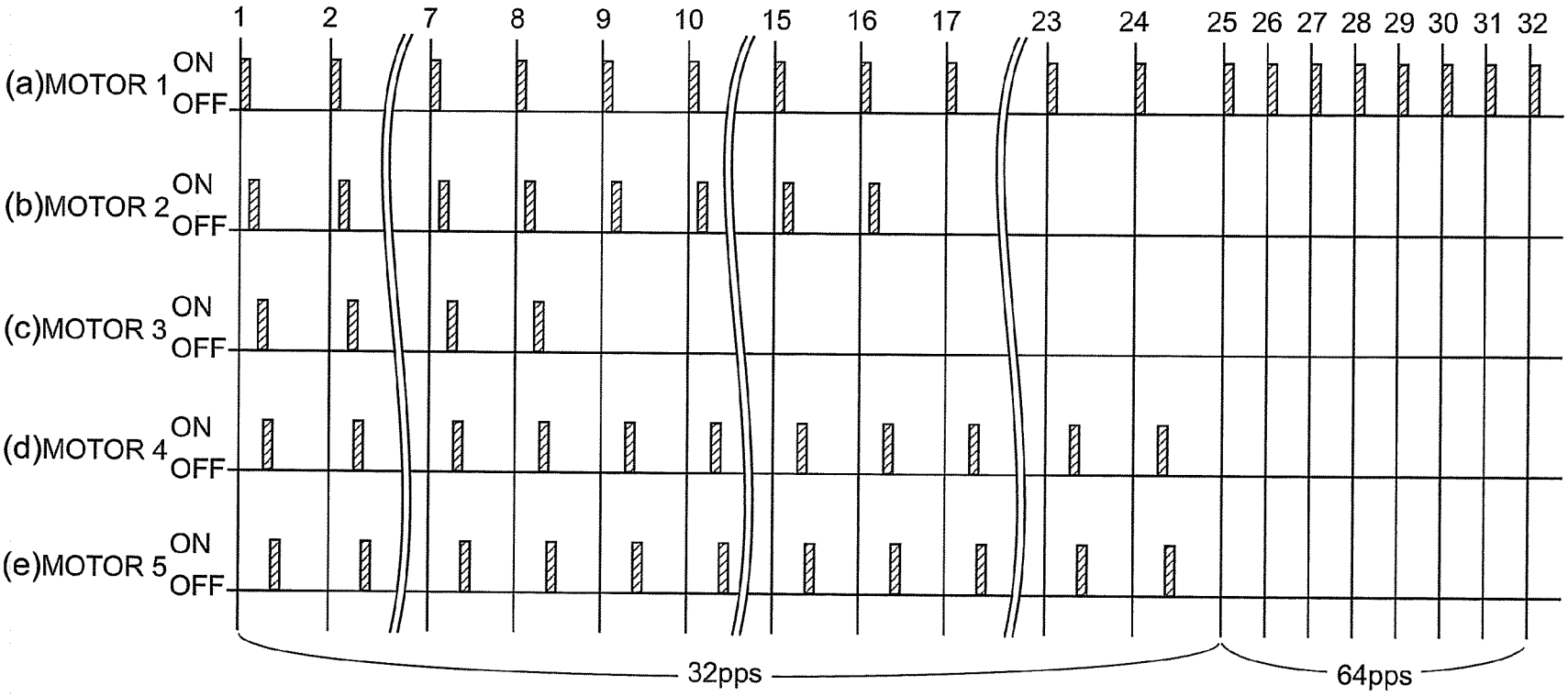
FIG. 4 is a time chart for describing a control pattern in the first example of the fast-forward control processing.

Successively, two concrete examples of the fast-forward control processing will be shown. FIG. 4 is a timing chart for describing the drive timing of each stepping motor in the first example of the fast-forward control processing.

As shown in the column of the "number of movement steps" in FIG. 3, it is supposed that the first to fifth stepping motors 21, 22, 31, 41, and 51 are designated to be subjected to the fast-forward drives by "32, 16, 8, 24, and 24" steps, respectively, in the first example of the fast-forward control processing. These numbers of steps are suitably changed according to the positions of the respective hands and the like before a start of fast-forwarding and according to the designated positions to which the respective hands are fast-forwarded.

In the example of FIG. 4, because the fast-forward operations of all of the first to fifth stepping motors 21, 22, 31, 41, and 51 are first needed at the time of starting the fast-forward operation, the slowest speed "32 pps" among these maximum fast-forward speeds is selected, and the first to fifth stepping motors 21, 22, 31, 41, and 51 are subjected to the fast-forward drive at the speed of 32 pps.

Then, the fast-forward drive at 32 pps is continued until both of the 1/10 second hand 15, driven by the third stepping motor 31, and the data indicator 18, driven by the fifth stepping motor 51, are moved to the respective designated positions, namely, until the $24^{th}$ step from the start of the fast-forward drive. During this period, the drives of the second stepping motor 22 and the third stepping motor 31, the numbers of movement steps of which are designated to those smaller than 24 steps, are stopped at the designated steps of 16 steps and 8 steps, respectively.

Then, after the completion of the fast-forward drive at 32 pps to the $24^{th}$ step, only the first stepping motor 21, to which the maximum fast-forward speed is set to 64 pps, becomes the object of the fast-forward control, and accordingly the fast-forward speed is changed to 64 pps from the next 25th step to continue the following fast-forward control. Then, the first stepping motor 21 is driven by a designated number of movement steps (32 steps), and the fast-forward control processing is ended.

The fast-forward control processing described above is adapted to perform the control of outputting the drive pulses to be transmitted to the respective motors at different timings in the drive period of one step, as shown in FIG. 4, when all of or some of the stepping motors 21, 22, 31, 41, and 51 are driven together. By this control, even if some of the stepping motors 21, 22, 31, 41, and 51 are driven together, it is possible to avoid the great reduction of the power source voltage owing to the overlaps of the output periods of the drive currents.

Figure 5:
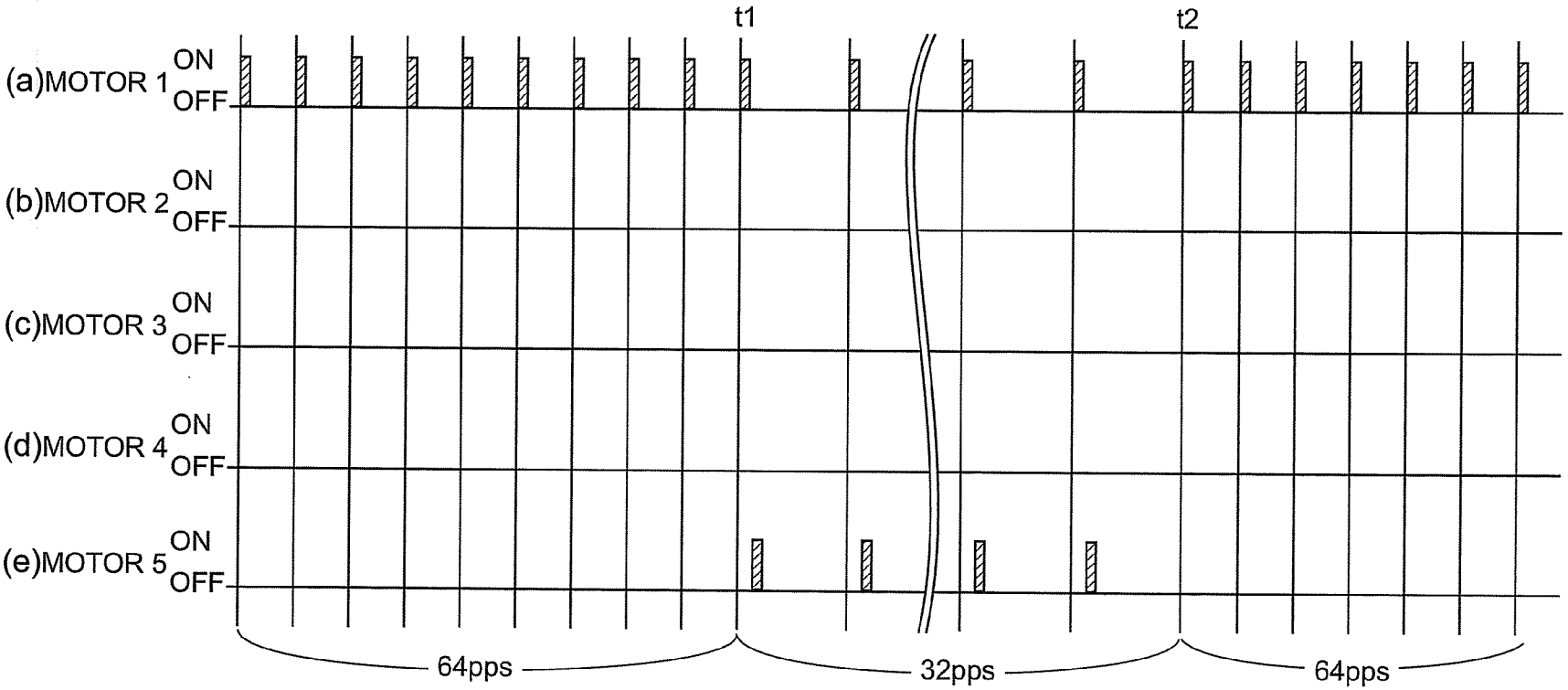
FIG. 5 is a time chart for describing a control pattern in a second example of the fast-forward control processing.

FIG. 5 shows a time chart for describing the control pattern of each stepping motor in a second example of the fast-forward control processing.

In the second example of the fast-forward control processing, a control pattern of the following case is shown, for example; that is, a case where a date is changed in the middle of the fast-forwarding of the hour hand 2 and the minute hand 3, and accordingly, the date indicator 18 is also fast-forwarded by predetermined steps.

In the example of FIG. 5, because only the first stepping motor 21 is the object of the fast-forward control until timing t1 which is the halfway point of the fast-forward control, the fast-forward drive of the first stepping motor 21 is being performed at the maximum fast-forward speed (64 pps).

Then, for example, in a period of timing t1-t2 when the date is changed and the fast-forward operation of the date indicator 18 is performed by the predetermined number of steps, the fifth stepping motor 51 is added as an object of the fast-forward control, and accordingly the speed "32 pps," which is the slower one between the maximum fast-forward speeds, is selected. Then, both of the first and fifth stepping motors 21 and 51 are driven at this speed.

Furthermore, in the period on and after the timing t2 at which the fast-forward operations of the hour hand 2 and the minute hand 3 are performed after the completion of the fast-forwarding of the date indicator 18, the object of the fast-forward control becomes only the first stepping motor 21 again, and accordingly the fast-forward drive of the first stepping motor 21 is performed at its maximum fast-forward speed (64 pps).

As shown in the first example (FIG. 4) and the second example (FIG. 5), mentioned above, according to the fast-forward control processing of this embodiment, if one or a plurality of the first to fifth stepping motors 21, 22, 31, 41, and 51 are subjected to fast-forward drives together and one or a plurality of hands 2-4, 12, 13, and 15 and the date indicator 18 are subjected to fast-forward operations, then a plurality of stepping motors are driven together while the speeds of the fast-forward drives are suitably changed. Consequently, the fast-forward control processing can be completed in a short time without driving a plurality of stepping motors at speeds different from each other in parallel at the same time.

Next, the fast-forward control processing described above will be described in detail with flow charts.

Figure 6:
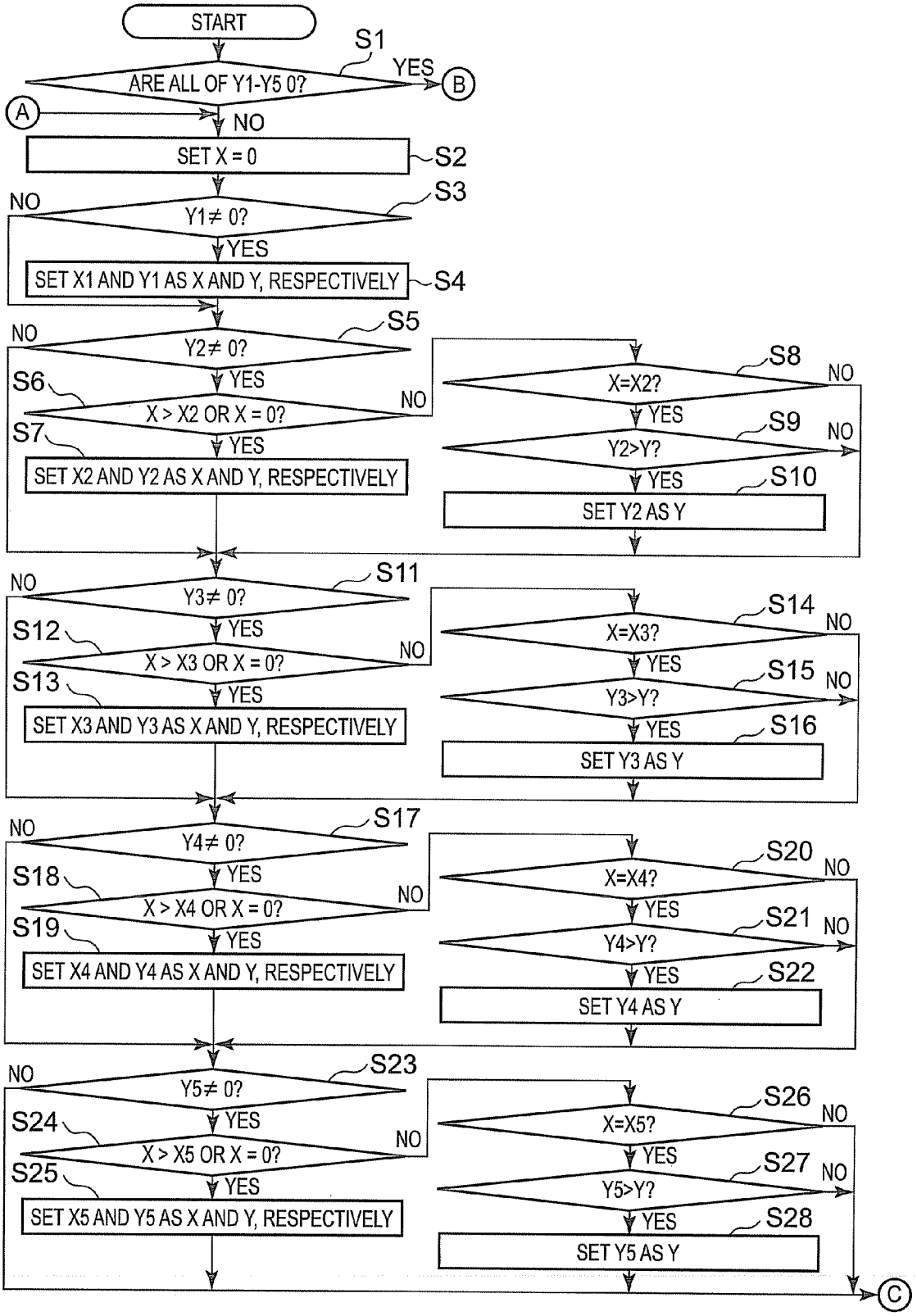
FIG. 6 is the first half portion of a flow chart showing the control procedure of the fast-forward control processing.
Figure 7:
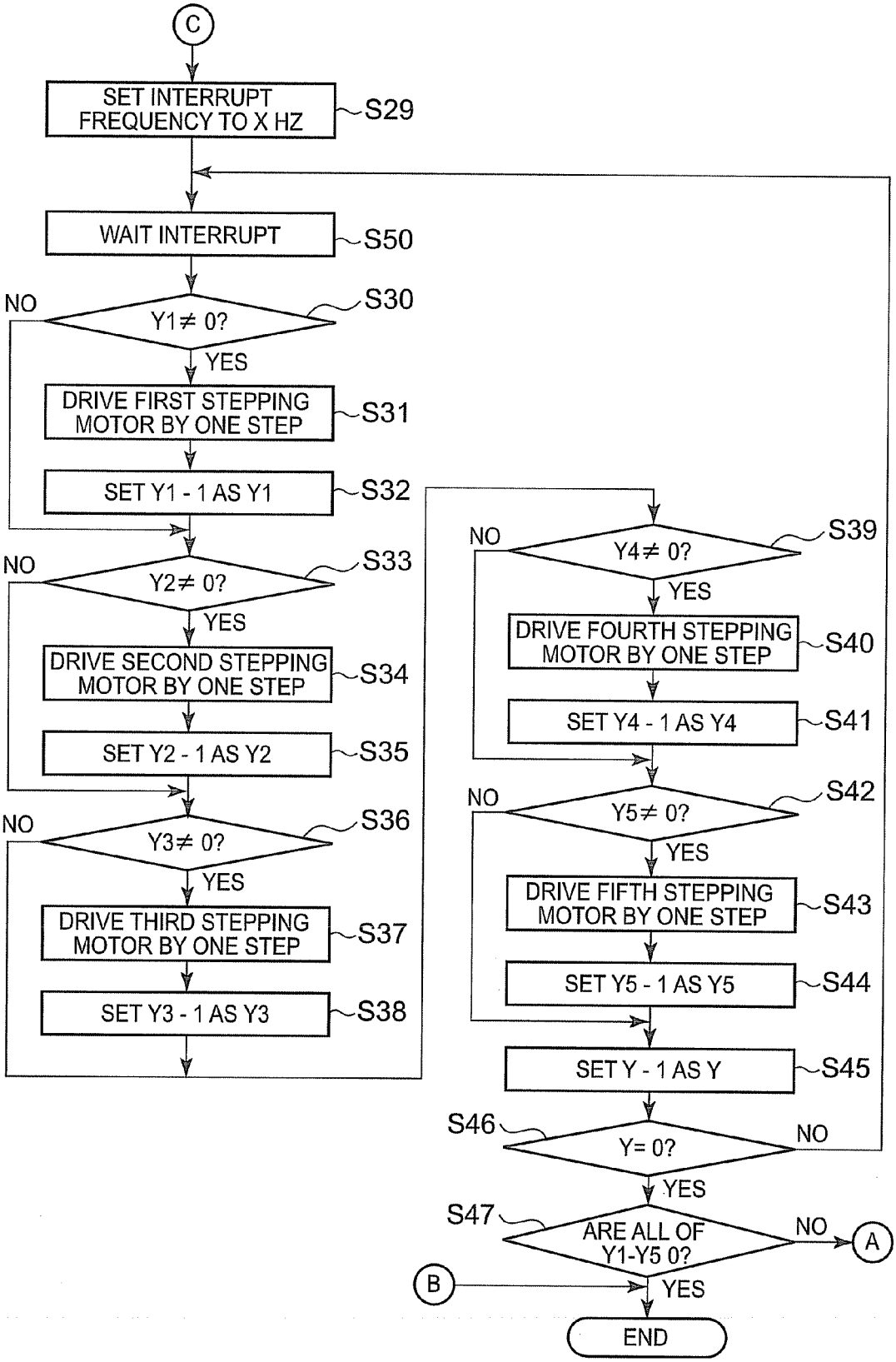
FIG. 7 is the second half portion of the flow chart showing the control procedure of the fast-forward control processing.

FIGS. 6 and 7 show the flow charts of the fast-forward control processing executed by the CPU of the control section 80. In the flow charts, constants X1-X5 denotes the maximum fast-forward speeds (pps) of the first to fifth stepping motors 21, 22, 31, 41, and 51, respectively; variables Y1-Y5 denote the remaining numbers of movement steps by which the first to fifth stepping motors 21, 22, 31, 41, and 51 need to be subjected to the fast-forward drives, respectively; a variable X denotes the fast-forward speed (pps) at which the stepping motors are actually driven; and a variable Y denotes a remaining number of movement steps for which the present fast-forward speed is continued.

If the fast-forward drives of the first to fifth stepping motors 21, 22, 31, 41, and 51 become necessary owing to a change of the operation mode of the timepiece 1 or the like, the number of movement steps Y1-Y5 by which the fast-forward drives of the stepping motors 21, 22, 31, 41, and 51 are performed respectively, is designated by other control processing, and the fast-forward control processing is started by the CPU of the control section 80.

When the control processing of the fast-forward operation is started, the CPU first checks whether all of the numbers of movement steps Y1-Y5 of the first to fifth stepping motors 21, 22, 31, 41, and 51, respectively, are "0" or not (Step S1). If all of the numbers of movement steps Y1-Y5 are "0," the processing branches to "YES," and the fast-forward control processing is ended as it is.

On the other hand, if not all of the numbers of movement steps Y1-Y5 are "0," the processing branches to "NO," and the setting processing of the fast-forward speed X, at which the stepping motors are actually driven, and the number of movement steps Y, by which the drive at this speed is continued, is started. Namely, the CPU first moves the processing to Step S2, and sets "0" as the initial value of the fast-forward speed X.

Successively, the CPU moves the processing to Step S3, and checks whether or not the number of movement steps Y1 of the first stepping motor 21 is not "0." If the result is not "0," the CPU sets the maximum fast-forward speed X1 of the first stepping motor 21 as the fast-forward speed X, and sets the number of movement steps Y1 of the first stepping motor 21 as the number of movement steps Y (Step S4). Then, the CPU moves the processing to Step S5. On the other hand, if the result is "0," the CPU moves the processing to Step S5 directly.

At Step S5, the CPU judges whether or not the number of movement steps Y2 of the second stepping motor 22 is not "0." If the result is not "0," the CPU moves the processing to the setting processing (Steps S6-S10) for reflecting the maximum fast-forward speed X2 and the number of movement steps Y2 of the second stepping motor 22 in the values of the fast-forward speed X and the number of movement steps Y. But, if the result is "0," the CPU moves the processing to Step S11 by omitting the setting processing.

When the processing moves to Step S6, the CPU first judges whether the maximum fast-forward speed X2 of the second stepping motor 22 is smaller than the present set value of the fast-forward speed X or whether the fast-forward speed X remains the initial value of "0." Then, if either of them is "YES," the CPU sets the maximum fast-forward speed X2 of the second stepping motor 22 as the fast-forward speed X, and sets the number of movement steps Y2 of the second stepping motor 22 as the number of movement steps Y (Step S7). Then, the CPU moves the processing to Step S11.

On the other hand, if both of them are "NO" at the judgment processing at Step S6, the CPU judges whether the maximum fast-forward speed X2 of the second stepping motor 22 is equal to the fast-forward speed X set at this point or not (Step S8). If both of them are equal to each other, the CPU judges whether the number of movement steps Y2 of the second stepping motor 22 is larger than the number of movement steps Y set at this point or not (Step S9). Namely, if both of the results of the judgments at Steps S8 and S9 are "YES," it is shown that the fast-forward speed X set at the preceding step is equal to the maximum fast-forward speed X2 and the change thereof is not necessary, but that the number of movement steps Y can be set to the number of movement steps Y2 of the second stepping motor 22, the number of movement steps becoming larger.

Accordingly, if both of the judgment results at Steps S8 and S9 are "YES," the CPU sets the number of movement steps Y, for which the same speed can be continued, to the number of movement steps Y2 at Step S10, and the CPU moves the processing to Step S11. Furthermore, if either of the judgment results at Steps S8 and S9 is "NO," the CPU moves the processing to Step S11 directly.

When the processing moves to Step S11, the CPU resets the set values of the fast-forward speed X and the number of movement steps Y, which are on the way of setting, to the values reflecting the maximum fast-forward speed X3 and the number of movement steps Y3 of the third stepping motor 31, by the processing at the subsequent Steps S11-S16. The processing at Steps S11-S16 is similar to that at Steps S5-S10, described above, and is different from that at Steps S5-S10 only in that the parameters which are the processing objects at Steps S5-S10 are changed from those of the second stepping motor 22 to those of the third stepping motor 31 in the processing at Steps S11-S16.

Furthermore, at subsequent Steps S17-S22, the CPU resets the set values of the fast-forward speed X and the number of movement steps Y, which are on the way of setting, to the values reflecting the maximum fast-forward speed X4 and the number of movement steps Y4 of the fourth stepping motor 41, and at the following Steps S23-S28, the CPU resets the set values of the fast-forward speed X and the number of movement steps Y, which are on the way of setting, to the values reflecting the maximum fast-forward speed X5 and the number of movement steps Y5 of the fifth stepping motor 51.

Namely, by the processing at Steps S2-S28, described above, the CPU sets the slowest speed among the maximum fast-forward speeds (X1-X5) of one or a plurality of stepping motors, the number of movement steps Y1-Y5 of which are set to zero or more, as the fast-forward speed X, at which the stepping motors are actually driven, and the CPU sets the largest number of steps among the number of movement steps (some of Y1-Y5) of one or a plurality of stepping motors, the maximum fast-forward speeds of which are set to the fast-forward speed X, as the number of movement steps Y, by which the drive at the fast-forward speed X can be continued.

Then, when the setting processing at Steps S2-S28, described above, ends, the CPU successively moves the processing to that of driving the stepping motors actually (Steps S29-S48).

When the processing moves to Step S29, the CPU first sets the frequency of an interrupt signal, operating as a standard for the fast-forward drives, to the value corresponding to the set fast-forward speed X, mentioned above, (Step S29). Namely, the CPU outputs a command to the frequency dividing/interrupt signal generating circuit 89 to change the frequency of the interrupt signal output from the frequency dividing/interrupt signal generating circuit 89 to a frequency corresponding to the fast-forward speed X, at which the stepping motors are actually driven.

Then, the CPU waits for the input of the interrupt signal from the frequency dividing/interrupt signal generating circuit 89 (Step S50). When the interrupt signal is input, the CPU first checks whether or not the number of movement steps Y1 of the first stepping motor 21 is not "0" (Step S30). If the result is not "0," the CPU outputs a control pulse to a drive circuit 83 to drive the first stepping motor 21 by one step (Step S31). Successively, the CPU subtracts one from the remaining number of movement steps Y1 of the first stepping motor 21 (Step S32), and the CPU moves the processing to Step S33.

On the other hand, if the remaining number of movement steps Y1 is "0" at the judgment processing at Step S30, it is unnecessary to drive the first stepping motor 21, and consequently the CPU moves the processing to Step S33 directly.

At subsequent Steps S33-S35, the CPU executes the processing similar to that at Steps S30-S32 which is to the first stepping motor 21, described above, to the second stepping motor 22. Similarly, the CPU executes the similar processing to the third to fifth stepping motors 31, 41, and 51 at Steps S36-S38, S39-S41, and S42-S44.

Namely, by the processing at Steps S50 and S30-S44, mentioned above, the CPU drives the stepping motors which are the objects of fast-forward control among the first to fifth stepping motors 21, 22, 31, 41, and 51 while shifting the drive timings of them slightly from each other step by step on the basis of the interrupt signal supplied from the frequency dividing/interrupt signal generating circuit 89.

Then, when the step-by-step drive processing of the stepping motors which are the objects of the fast-forward control, mentioned above, has been completed, the CPU next subtracts "1" from the value of the number of movement steps Y, for which the drive can be continued at this speed (Step S45), and the CPU judges whether the number of movement steps Y arrives at "0" or not (Step S46). If the result is not "0," the CPU returns the processing to Step S50, and the CPU again repeats the step-by-step drive processing (at Steps S30-S44) of the stepping motors which are the objects of the fast-forwarding on the basis of the interrupt signal.

By such repetition processing, the CPU results in driving the stepping motors which are the objects of the fast-forward control step by step at the period of the interrupt signal by the number of movement steps Y, for which the drives can be continued at the same speed. Furthermore, the CPU results in stopping the drives of the stepping motors, the drives of the necessary numbers of movement steps of which have been completed in the middle of the drives, when the values of the numbers of movement steps (Y1-Y5) are changed to "0."

On the other hand, if the number of movement steps Y, for which the drives at the same speed can be continued, is "0" as the result of the judgment at Step S46, the CPU first judges whether all of the remaining numbers of movement steps Y1-Y5 of the stepping motors 21, 22, 31, 41, and 51, respectively, are "0" or not. If not all of them are "0," the CPU returns the processing to Step S2 in order to change the fast-forward speed and continue the fast-forward processing. Then, the CPU performs the setting processing of the fast-forward speed X, at which the stepping motors are next driven, and the number of movement steps Y, for which the drives at the fast-forward speed X can be continued, by the setting processing at Steps S2-S28, and the CPU again executes the processing of the fast-forward drives at Steps S29, S50, and S30-S47. When the number of the stepping motors which are the objects of the fast-forward control is decreased and the slowest maximum fast-forward speed is changed, the CPU again sets the slowest speed among the maximum fast-forward speeds of the stepping motors which are the objects of the fast-forward control as the fast-forward speed X, and the CPU is adapted to be able to continue the drive control, by such repetition processing.

Then, when all of the remaining numbers of movement steps Y1-Y5 of the stepping motors 21, 22, 31, 41, and 51, respectively, arrive at "0" by such repetition processing, the CPU judges the situation by the judgment processing at Step S47, and the CPU ends the control processing of the fast-forward operation.

In addition, as shown in the timing chart of FIG. 5, if a stepping motor which is the object of fast-forward control is newly joined in the middle of the fast-forward control of a certain stepping motor, the CPU newly resets the remaining numbers of movement steps Y1-Y5 of the stepping motors 21, 22, 31, 41, and 51, respectively, by the other control processing, and thereby the CPU intercepts the fast-forward control processing of FIGS. 6 and 7 during the waiting of an interrupt signal. Then, the CPU is adapted to newly start the processing from Step S1. Consequently, the CPU is adapted to execute the fast-forward control of each of the stepping motors 21, 22, 31, 41, and 51 shown in the timing chart of FIG. 5.

As described above, according to the analog electronic timepiece 1 of this embodiment, if the number of the stepping motors to be subjected to the fast-forward drives increases or decreases and the slowest maximum fast-forward speed among the maximum fast-forward speeds of the stepping motors to be driven is changed when a plurality of hands are fast-forwarded by the plurality of stepping motors to each of which a fast-forward speed different from each other is set, then the CPU changes the fast-forward drive to that at the new slowest maximum fast-forward speed at the timing when the slowest maximum fast-forward speed is changed, and consequently the fast-forward drives of the plurality of stepping motors can be performed easily and efficiently.

Furthermore, if the fast-forwarding of the hand at the slowest maximum fast-forward speed has ended earlier than that of the other hands, the CPU raises the speed to the slowest maximum fast-forward speed among the maximum fast-forward speeds of the remaining hands to be fast-forwarded, to perform the fast-forwarding, and consequently it is unnecessary to continue the fast-forward drives at an unnecessary slow fast-forward speed, which enables the performance of efficient fast-forwarding.

Furthermore, if a hand to which a slower maximum fast-forward speed is set is joined to fast-forward drives while some hands are being subjected to the fast-forward drives at the slowest maximum fast-forward speed, then the CPU lowers the slowest maximum fast-forward speed to the slower maximum fast-forward speed at the timing of the joining of the hand to the fast-forwarding, and then the CPU performs the fast-forward drives. Consequently, it is unnecessary to adjust the fast-forward speed to the slower fast-forward speed in advance.

Furthermore, because the CPU outputs a drive pulse for one step to each of a plurality of stepping motors while shifting the timing of the outputting little by little for each of the plurality of stepping motors, in a drive period of one step of the plurality of stepping motors, excessive power is not needed at a time, and the fast-forward drives of a plurality of hands can stably be performed.

Furthermore, because fast-forward control can be performed in synchronization with interrupt signals of various frequencies to be input from the frequency dividing/interrupt signal generating circuit to the CPU by changing the frequency dividing ratio of the frequency dividing/interrupt signal generating circuit, the fast-forward control of a plurality of stepping motors can easily be performed.

Furthermore, the rotating disk to be rotated by the gear train mechanism is also included in the hands to be fast-forwarded by the drives of such a plurality of stepping motors, and the present invention can also be used for the case of performing the display and changes of a date or the like by exposing apart of the marks written on the rotating disk onto the dial plate.

In addition, the present invention is not limited to the embodiment described above, but various changes can be performed. For example, although the embodiment, described above, is configured to anew calculate the next slowest maximum fast-forward speed X and the number of movement steps Y at the step at which the drives of the number of movement steps Y at the slowest maximum fast-forward speed X end, the method of obtaining each parameter necessary for the control of fast-forward drives can be variously changed, for example, the method of previously calculating each of the fast-forward speeds X to be changed several times from the start of fast-forwarding to the end thereof and each of the numbers of movement steps Y, for which the drive of each fast-forward speed can be continued, before the start of the drives of the stepping motors.

Furthermore, although the example of performing the fast-forward drives of the plurality stepping motors on the basis of an interrupt signal is shown in the embodiment, described above, it is also possible to adopt the method of obtaining the timing of the fast-forward drives of the plurality of stepping motors by counting faster frequency signals with a counter of hardware or software.

In addition, the details shown in the embodiment concretely, such as the kinds and number of the hands and the rotating disks, and the number and the specifications of the stepping motors, can suitably be changed without departing from the spirit and scope of the invention.

The entire disclosure of Japanese Patent Application No. 2009-212837 filed on Sep. 15, 2009 including description, claims, drawings, and abstract is incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. An analog electronic timepiece comprising:

a plurality of hands to indicate time;

a plurality of stepping motors to drive the plurality of hands respectively, a maximum speed of at least one stepping motor being different from a maximum speed of another stepping motor among the plurality of stepping motors; and a fast-forward control section to simultaneously drive at least two of the plurality of stepping motors to simultaneously fast-forward at least two of the plurality of hands, the fast-forward control section including:

a speed judging section to judge the slowest speed among maximum speeds of stepping motors of hands to be moved among the plurality of stepping motors;

a drive control section to simultaneously drive the stepping motors of the hands to be moved at the speed judged by the speed judging section;

an end judging section to judge whether a further hand to be moved remains or not when drive of the stepping motors at the speed judged by the speed judging section ends; and a control section to make the speed judging section, the drive control section, and the end judging section operate again when the end judging section judges that the hand to be moved remains.

2. The analog electronic timepiece according to claim 1, wherein the drive control section drives the at least two of the plurality of stepping motors at a same period by shifting timing.

3. The analog electronic timepiece according to claim 1, wherein at least one hand rotates in conjunction with another hand among the plurality of hands, with rotation of the another hand transmitted to the at least one hand.

4. The analog electronic timepiece according to claim 1, wherein the fast-forward control section includes a storage section to store the number of steps by which each of the plurality of stepping motors is driven, and the drive control section subtracts one from the number of steps at every drive of the stepping motor by one step, and stops the drive when the number of steps arrives at 0.

5. The analog electronic timepiece according to claim 4, wherein the speed judging section judges the slowest speed among the maximum speeds of the stepping motors, the number of steps of each of the stepping motors stored in the storage section.

6. The analog electronic timepiece according to claim 1, further comprising a signal generating section to supply a frequency signal to the fast-forward control section, wherein the drive control section drives one or a plurality of stepping motors being objects of fast-forward control step by step on the basis of the frequency signal supplied from the signal generating section, and the drive control section includes a frequency changing section to change drive speeds of the one or the plurality of stepping motors by changing a frequency of the frequency signal.

7. The analog electronic timepiece according to claim 1, wherein the plurality of hands include a rotating disk, the rotating disk having one of a plurality of marks, numerals, and characters on top surface thereof, and the rotating disk rotating with at least a part of one of the plurality of marks, numerals, and characters exposed from a plate on the rotating disk.

8. A stepping motor driving method of an analog electronic timepiece including a plurality of hands to indicate time, and a plurality of stepping motors to drive the plurality of hands respectively, a maximum speed of at least one stepping motor being different from a maximum speed of another stepping motor among the plurality of stepping motors, to simultaneously drive at least two of the plurality of stepping motors to simultaneously fast-forward at least two of the plurality of hands, the method comprising the steps of:

judging the slowest speed among maximum speeds of stepping motors of hands to be moved among the plurality of stepping motors;

simultaneously driving the stepping motors of the hands to be moved at the speed judged at the step of judging the slowest speed;

judging whether a further hand to be moved remains or not when drive of the stepping motors at the speed judged at the step of judging the slowest speed ends; and performing the steps of judging the slowest speed, simultaneously driving the stepping motors, and judging whether the further hand to be moved remains or not again when it is judged that the hand to be moved remains.

9. The stepping motor driving method according to claim 8, wherein the step of simultaneously driving the stepping motors is a step of driving at least two of the plurality of stepping motors at a same period by shifting timing.

10. The stepping motor driving method according to claim 8, wherein the number of steps by which each of the plurality of stepping motors is driven is stored in a storage section, and the step of simultaneously driving the stepping motors is a step of subtracting one from the number of steps stored in the storage section, at every drive of the stepping motor by one step, and stopping the drive when the number of steps arrives at 0.

11. The stepping motor driving method according to claim 8, wherein the number of steps by which each of the plurality of stepping motors is driven is stored in a storage section, and the step of judging the slowest speed is a step of judging the slowest speed among the maximum speeds of the stepping motors, the number of steps of each of the stepping motors stored in the storage section.

12. The stepping motor driving method according to claim 8, wherein the step of simultaneously driving the stepping motors includes a step of changing a frequency of a frequency signal of a signal generating section to supply the frequency signal on the basis of a judgment result at the step of judging the slowest speed, and the step of simultaneously driving the stepping motors is a step of driving one or a plurality of stepping motors being objects of fast-forward control step by step on the basis of the frequency signal supplied from the signal generating section.

* * * * *